United States Patent [19]

O'Keefe

[11] Patent Number: 4,815,728

[45] Date of Patent: Mar. 28, 1989

[54] AMUSEMENT RIDE

[76] Inventor: Stephen J. O'Keefe, 4D River Dr., Danvers, Mass. 01923

[21] Appl. No.: 127,264

[22] Filed: Dec. 1, 1987

[51] Int. Cl.[4] ..... A63G 1/00

[52] U.S. Cl. ..... 272/38; 272/29

[58] Field of Search ..... 272/29, 36–28, 272/49–50

[56] References Cited

U.S. PATENT DOCUMENTS

| | | | |
|---|---|---|---|
| 853,155 | 5/1907 | Boardman | 272/38 |
| 900,820 | 10/1908 | Becker | 272/38 |
| 2,423,283 | 7/1947 | Austin | 272/36 |
| 2,828,128 | 3/1958 | Castille | 272/50 X |
| 2,864,614 | 12/1958 | Castille | 272/38 X |
| 2,934,341 | 4/1960 | Shepherd | 272/38 |
| 3,456,943 | 7/1969 | Brown | 272/29 |
| 3,612,517 | 10/1971 | Schwarzkopf | 272/29 |

FOREIGN PATENT DOCUMENTS

| | | | |
|---|---|---|---|
| 1130535 | 2/1957 | France | 272/38 |

*Primary Examiner*—David A. Scherbel
*Assistant Examiner*—Richard E. Chilcot, Jr.
*Attorney, Agent, or Firm*—Chenpatents

[57] ABSTRACT

A Ferris wheel amusement ride has a main wheel supported by a shaft secured on top of two towers. A plurality of subwheels is mounted on the periphery of the main wheel and a plurality of passenger cabs is pivotally mounted on and with their longitudinal axes along, the periphery of the subwheels. A hydraulic system is provided for independently driving the main wheel and the subwheels. The passenger cabs are manually rotated by the passengers about the longitudinal axes thereof.

6 Claims, 5 Drawing Sheets

AMUSEMENT RIDE

BACKGROUND OF THE INVENTION

1. Field of the Invention

This invention relates to an amusement ride and more specifically to a Ferris wheel with three independent rotating movements of a main wheel, subwheels and passenger cabs.

2. Description of the Prior Art

Amusement rides of the Ferris wheel type have long been in use for entertainment. Generally, a main wheel is supported via its shaft by a frame. Along the periphery of the main wheel, there is suspended a plurality of seat carriages which are in their upright position at all times. The Ferris wheel is driven either electrically or hydraulically. A brake system is provided for stopping the main wheel for loading and unloading passengers.

More elaborate amusement rides of this general type have come into use in the course of time. U.S. Pat. No. 853,155 shows a plurality of smaller wheels rotatably mounted on a main wheel, passenger carriages being mounted along the periphery of the smaller wheels. U.S. Pat. No. 2,800,328 discloses a foldable Ferris wheel with two wheels rotatably mounted at the ends of two rotating arms and a plurality of passenger seats suspended from the ends of the spokes of each wheel. U.S. Pat. No. 2,934,341 discloses a ride having four radial spokes connected to a hub supported by a shaft and support structure. At the end of each of the spokes, there are mounted wheels along whose periphery there is suspended a plurality of passenger Carriages which remain in their upright position at all times. There has not thus far been an amusement ride with a main wheel and a plurality of subwheels which affords the ride the added thrill of being able to rotate the passenger cab sideways and upside down under the driver's own control.

SUMMARY OF THE INVENTION

The amusement ride in accordance with this invention is directed to a Ferris wheel having a main wheel rotatably mounted on a shaft supported by two towers. The main wheel has along its periphery a plurality of subwheels, which in turn have mounted along their peripheries a plurality of passenger cabs which do not remain in an upright position and which can be rotated by the passenger via a steering wheel.

The main objective of this invention is to provide a ride having a main wheel, subwheels and passenger cabs with three independent rotations and speeds. Another objective of this invention is to provide a hydraulic system for transmitting independent rotary motions to the main wheel and subwheels. A still further objective is to provide a trailer-portable amusement ride.

DESCRIPTION OF PREFERRED EMBODIMENT

The above objectives and advantages should become apparent from the following description in conjunction with the drawings.

Figure 1:
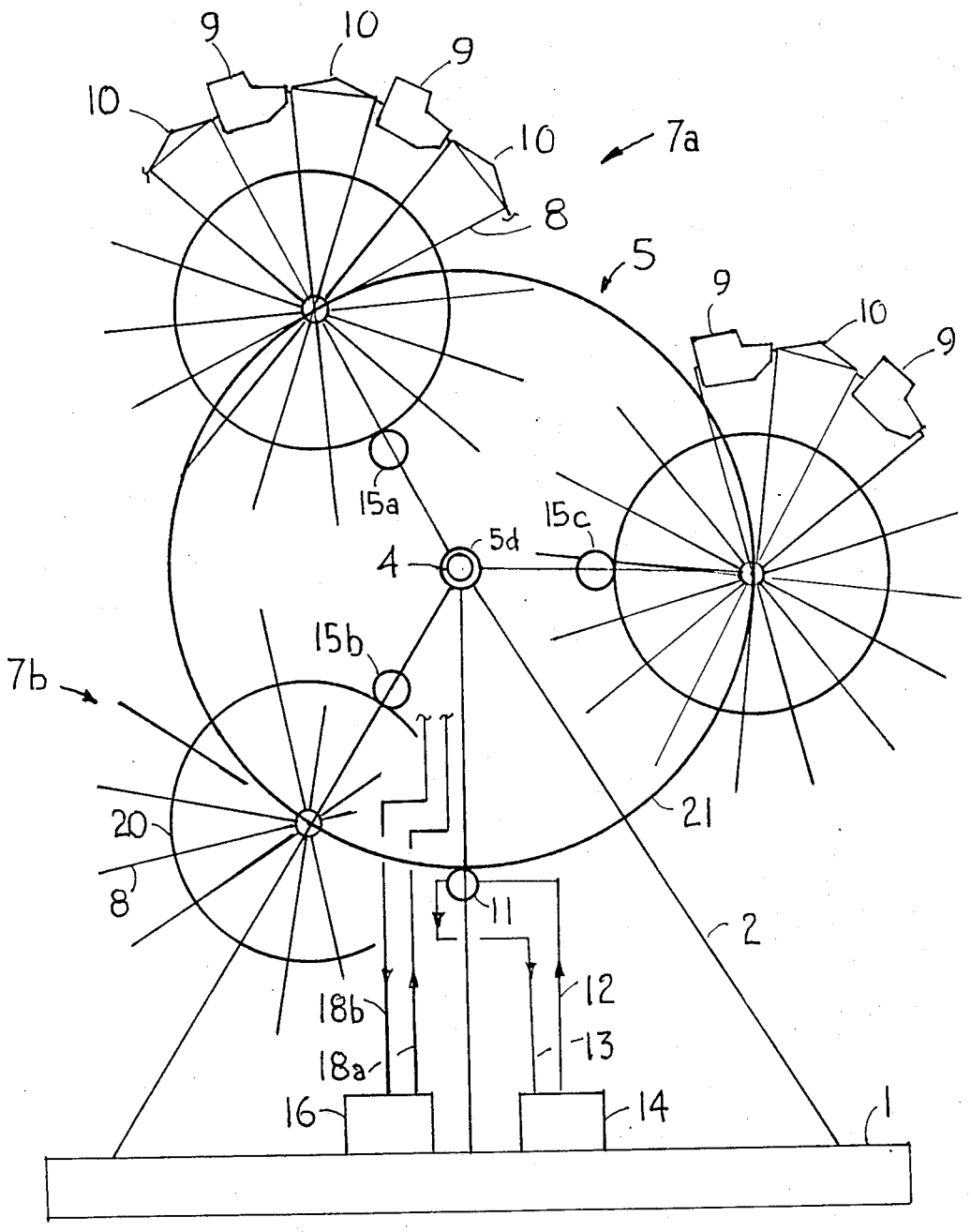
FIG. 1 is a side elevation view of the amusement ride of the present invention.
Figure 2:
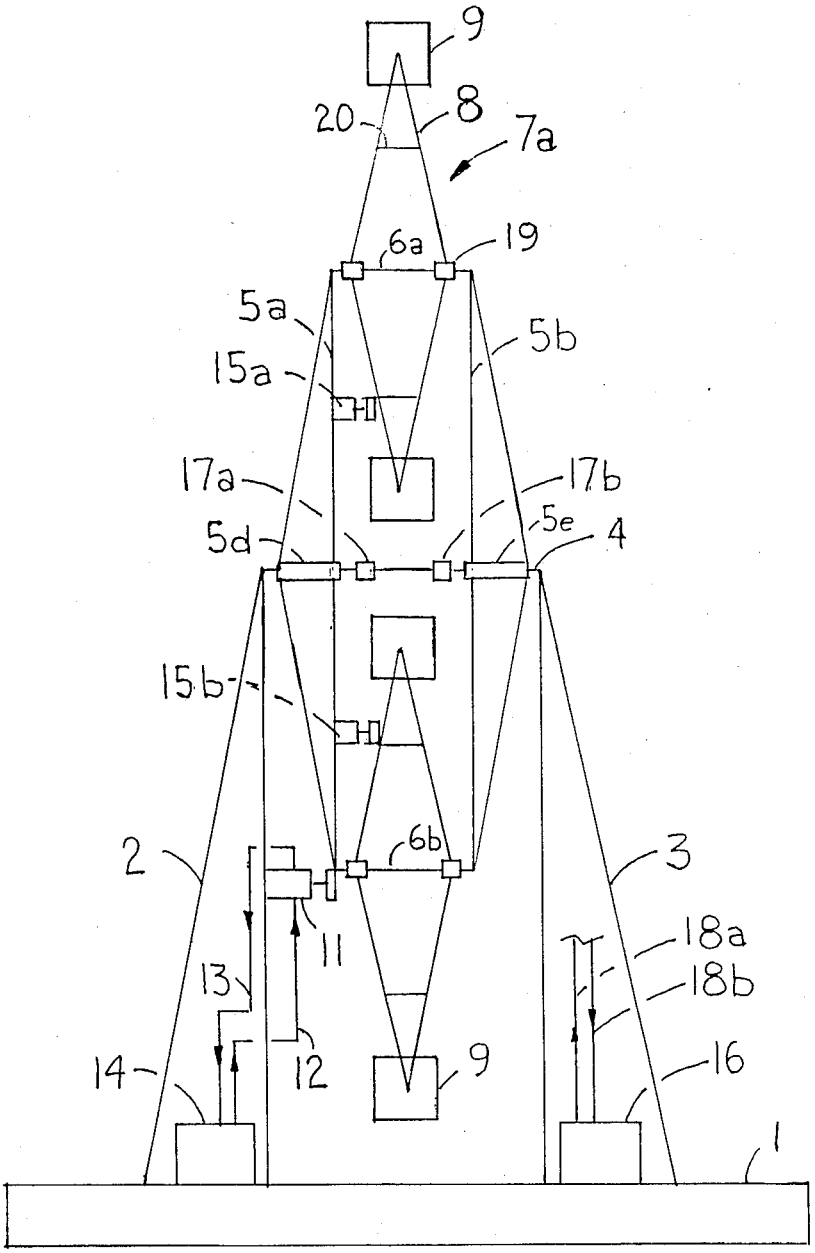
FIG. 2 is an end view of the amusement ride.

Referring to FIGS. 1 and 2, the amusement ride in accordance with the present invention comprises a platform 1 which supports two towers, 2 and 3. The tops of these towers are connected by a horizontal shaft 4 whose ends are rigidly connected to the towers 2 and 3. A main wheel assembly 5, hereinafter referred to as main wheel consisting of two parallel wheels 5*a* and 5*b* spaced some distance apart rotates on this shaft between the two parallel towers wheels. The two wheels 5*a* and 5*b* are crossconnected along their peripheries by cross braces (not shown) which maintain the wheels parallel and synchronized. The main wheel is generally circular, with spokes radiating from the hubs 5*d*,5*e* of the wheels 5*a* and 5*b*, said hubs being rotatably mounted on the ends of the shaft 4.

Also cross-connecting the two wheels 5*a* and 5*b* along their peripheries are three shafts 6*a*,6*b* and 6*c*, spaced equal distance from each other or 120° apart along the circumference of the main wheel. There are three subwheels, 7*a*,7*b* and 7*c* rotatably mounted on the three corresponding shafts 6*a*,6*b* and 6*c*. Three such shafts and subswheels are here described and illustrated in FIG. 1. For the sake of clarity, FIG. 2 shows only two subwheels. It is to be understood that this invention is not limited as to he number of subwheels.

The tower, main wheel and subwheels are stiffened and cross-braced by known means which are not described nor illustrated.

The structure of these subwheels is generally similar to that of the main wheel; their diameter, however, is smaller. The spokes 8 of the subwheels similarly radiate from their hubs, 19 and extend beyond the rims, 20 of the subwheels. As shown in FIG. 2, each pair of the opposing spokes, 8 converges to a point, free end of spokes 8 of subwheels. Between the ends of adjacent spokes, there are mounted alternately passenger cabs 9 and spreader bars 10.

Figure 4:
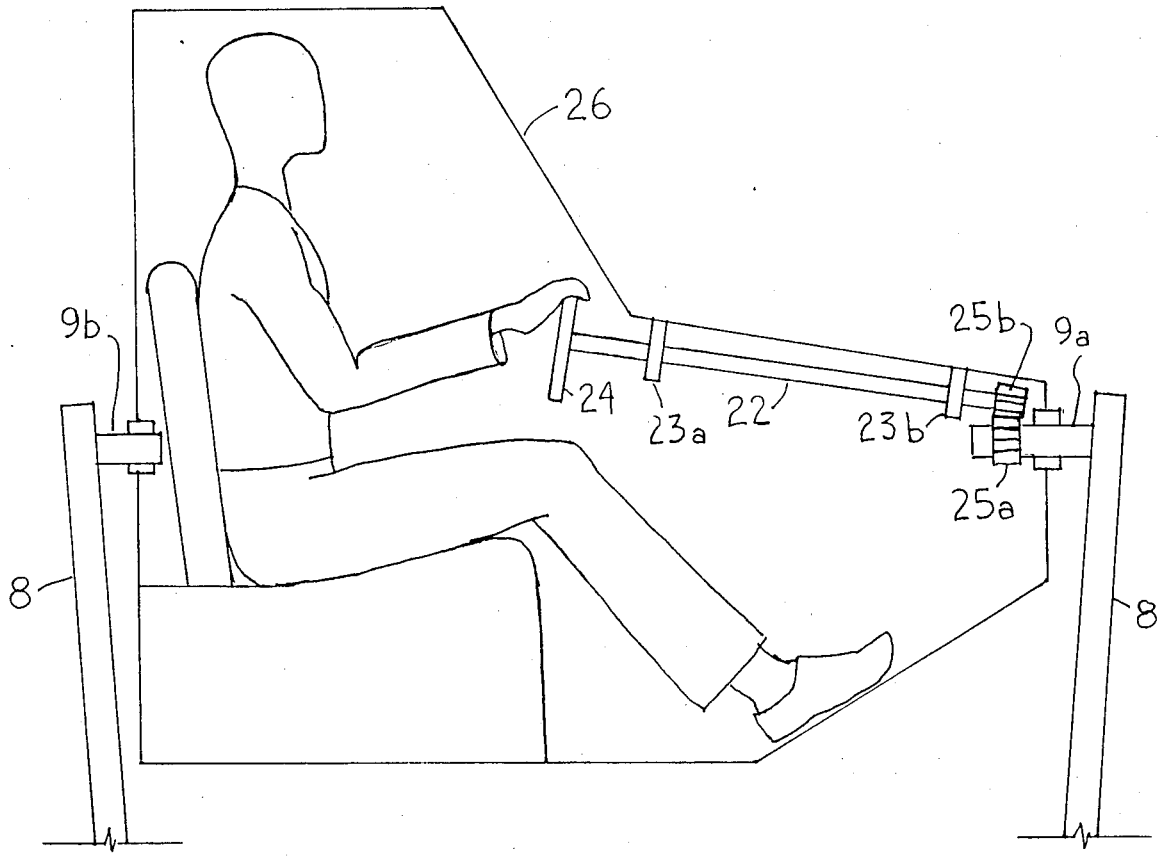
FIG. 4 shows the general structure of the passenger cab and its longitudinal axis of rotation.
Figure 5:
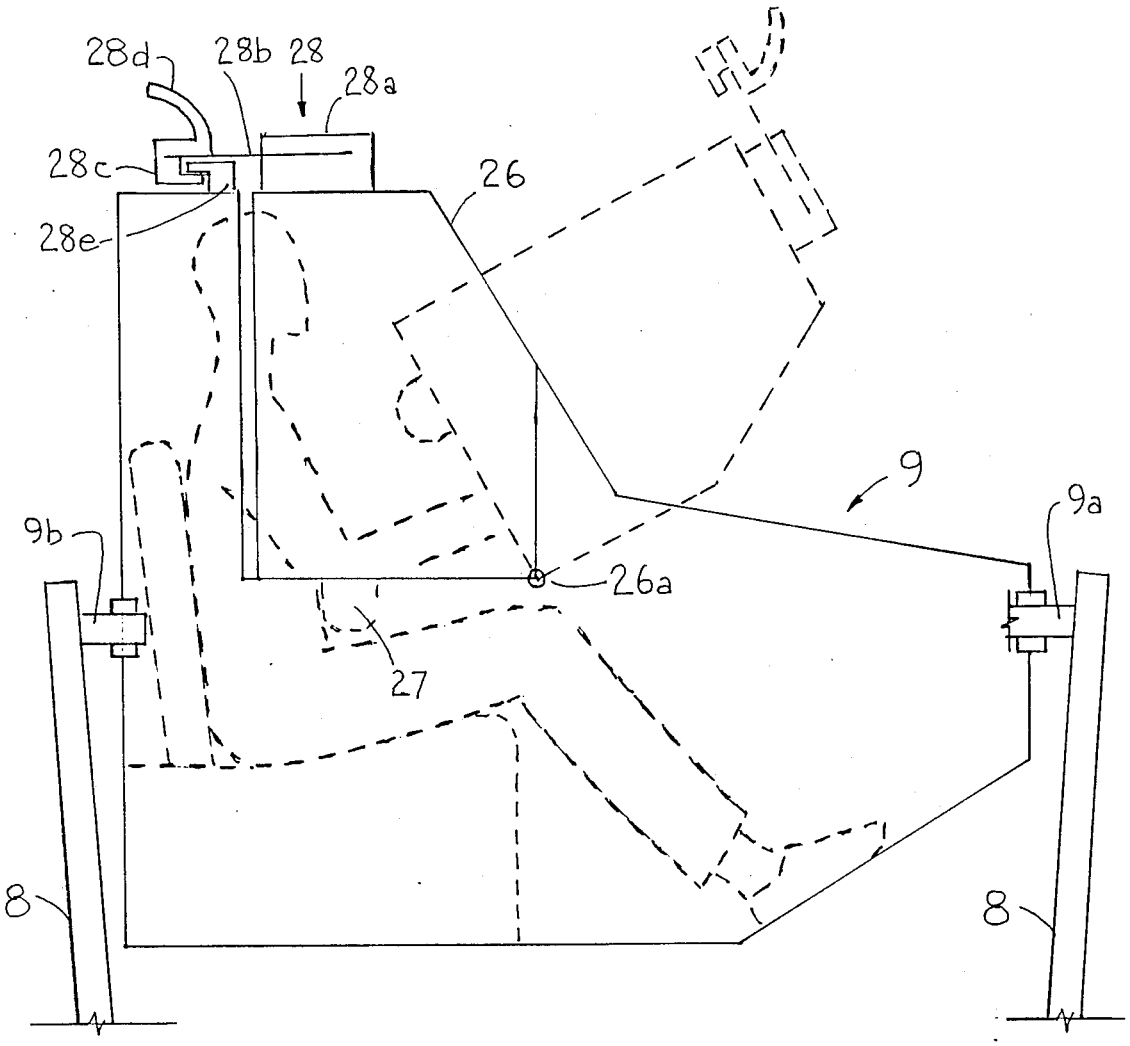
FIG. 5 shows a detailed side view of the passenger cab with details of the cab closure.

Referring to FIGS. 4 and 5, the passenger cabs 9 are supported by shafts 9*a* at the front and 9*b* at the rear of the passenger cab, these shafts being transversely connected to the ends of the spokes 8 of the subwheels and allowing rotation by each passenger cab around its own longitudinal axis. It is apparent that the passenger cabs' axes of rotation themselves rotate with the subwheels' and main wheel's rotation, allowing a greater variety motions than has ever been offered by any Ferris wheel amusement ride known theretofore.

The main wheel and the subwheels are driven hydraulically by two independent systems. The main wheel 5 is driven by at least one hydraulic motor 11 via a gear drive engaging a gear along the periphery 21 of the main wheel 5. The details of such a gear drive are described in U.S. Pat. No. 853,155 and are incorporated herewith by reference. The speed and direction of rotation of the main wheel is controlled by the flow rate and flow direction of hydraulic fluid circulated through the hydraulic motor 11 via a supply pipe 12 and a return pipe 13. The pressure, flow rate and flow direction of the hydraulic fluid is controlled by an electrically-driven pump 14, mounted on the platform 1.

Figure 3A:
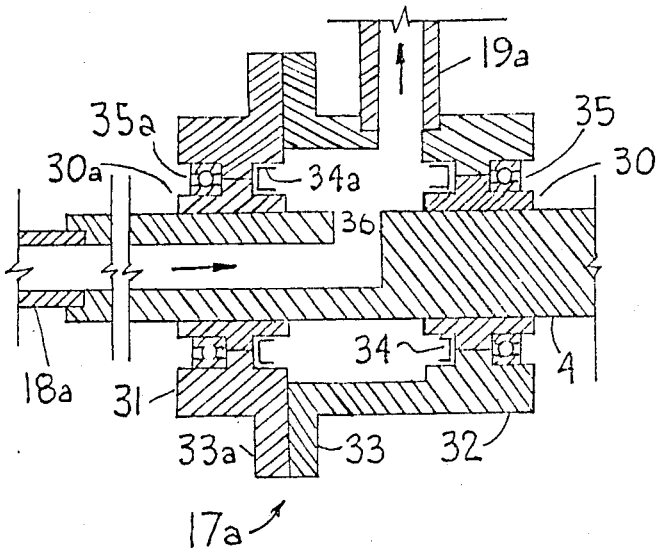
FIG. 3*a* illustrates the details of a single hydraulic commutator used for delivering hydraulic fluid from the stationary to the rotating part of the hydraulic piping system.
Figure 3B:
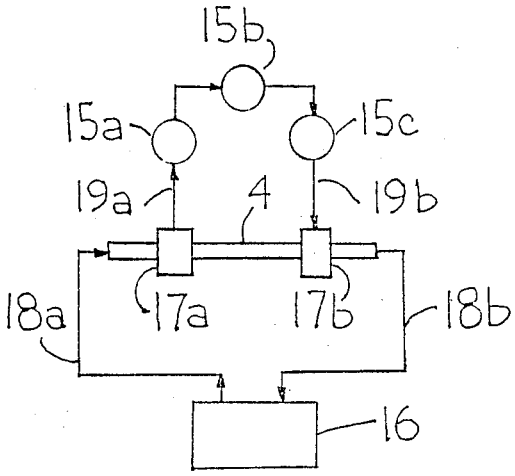

The subwheels are similarly driven by hydraulic motors 15*a*, 15*b*, and 15*c* which are correspondingly mounted on the spokes of the main wheel and which rotate the subwheels via gear drives provided at rims, 20 thereof as described in U.S. Pat. No. 853,155. The speed and direction of rotation of the subwheels may be controlled indepedently of the speed and direction of rotation of the main wheel. The subwheel hydraulic motors 15*a*,15*b*, and 15*c* are connected via hydraulic fluid pipes 18*a* and 18*b* to an electrically-driven pump 16 mounted on the platform 1, via commutators 17*a* and 17*b*, to be described as follows:

Referring to FIGS. 3*a* and 3*b*, the hydraulic fluid pipes 19*a*,19*b*, 18*a* and 18*b* connecting the hydraulic motors 15*a*, 15*b*, and 15*c* with the pump 16 are in fluid communication with a pair of hydraulic commutators 17*a* and 17*b* in sequence. The commutators are mounted on shaft 4 and provide means for transmitting hydraulic fluid from the stationary pipe 18*a* connected to the pump 16 to the rotating pipe 19*a* connected to the hydraulic motors 15*a*, 15*b* and 15*c* and for returning hydraulic fluid via the rotating pipe 19*b* and the stationary return pipe 18*b* back to the pump 16.

As illustrated in FIG. 3*b*, the hydraulic motors 15*a*, 15*b* and 15*c* are connected in series. It is to be understood that the hydraulic motors may also be connected in parallel.

As shown in FIG. 3*a*, the hydraulic commutator 17*a* comprises two rotating bodies 31 and 32 connected by two flanges 33 and 33*a* which preferably are bolted together in conventional manner (bolts not shown). The hydraulic commutator further comprises two stationary sleeves 30 and 30*a* which are fixed to the main shaft 4 by conventional means such as keys or set screw (details not shown). These elements 31, 32, 30, 30*a* enclose an annular space, in fluid communication with pipe 18*a* via an aperture 36 on the shaft 4. It is noted that stationary pipe 18*a* transmits hydraulic fluid through shaft 4, and into the annular space of rotary commutator 17*a* and then to rotating pipe 19*a*. The rotating and stationary elements are maintained in proper alignment by two sets of ball bearings 35 and 35*a* which are held in place by conventional means. Leakage of hydraulic fluid is prevented by self-sealing seal rings 34 and 34*a*. The commutators rotate about shaft 4, thus enabling pipes 19 to rotate.

A second commutator 17*b*, being a mirror image of the commutator 17*a* is also mounted on the shaft 4 in the same manner as commutator 17*a*, for returning hydraulic fluid to the pump 16.

A pneumatic brake system (not shown) is provided to brake the motion of the main wheel. The subwheels are braked hydraulically; no pneumatic commutators are required. As the brake systems either pneumatic or hydraulic are known, there is no discussion necessary.

The passenger cabs 9, as illustrated in FIGS. 4 and 5, are completely enclosed for the sake of passenger safety. They are supported by shafts 9*a* at the front of the cab and 9*b* at the rear of the cab, these shafts being rigidly connected to the ends of the spokes 8 of the subwheels. The passenger cabs are able to rotate about their longitudinal axes as defined by the shafts 9*a* and 9*b*. On shaft 9*a*, inside the passenger cab, there is provided a gear 25*a* which engages or meshes with another gear 25*b* on a steering column 22 which is supported from walls of the passenger cab by brackets 23*a* and 23*b*. At the end of the steering column 22, there is provided a steering wheel 24. As the rider in the passenger cab turns the steering wheel, the gears 25*a* and 25*b* cause the passenger cab to rotate on its longitudinal axis.

Referring to FIG. 5, access to the passenger cabs is from the top. After the passenger has climbed into the cab and sat down on seat, a three-sided cover 26 is swung shut and latched and the passenger is kept in safe position by a padded bar 27, transversely secured at the base of the cover 26. The cover 26, which may be made of wire mesh or transparent plastic, pivots on 26*a* and 26*b*. A latch 28 is secured on the top of the cover 26, said latch consisting of a bracket 28, connected to a steel leaf spring 28*b* and a hook 28*c* with a handle 28*d* attached to the leaf spring 28*b*. On the roof of the passenger cab 9, there is provided a matching hook 28*e*. When the cover is closed, hook 28*c* engages hook 28*e*, thereby securing the cover 26. The handle 28*d* facilitates engaging and disengaging the hook 28*c* and 28*e*. The detailed construction of the passenger cabs is described in U.S. Pat. No. 3,456,943, the content of which is hereby incorporated by reference.

The Ferris wheel amusement ride in accordance with the present invention may be constructed with telescopes extentions, detachably interconnected shafts which are foldable and are transported in collapsed position by a trailer as described in U.S. Pat. No. 3,612,517, the contents of which is hereby incorporated by reference.

Numerous modifications and variations of the present invention are possible in light of the above teachings and therefore, within the scope of the appended claims; the invention may be practiced otherwise than as particularly described.

I claim:

1. An improved amusement ride of the Ferris wheel type having two spaced towers and a main wheel consisting of two parallel wheels rotatably mounted on a horizontal first shaft, supported by said two towers for rotation about said first shaft, the improvement comprising:

a plurality of subwheels having hubs and rims, rotatably mounted at the periphery of the main wheel at equal distances therebetween and each supported by a second shaft, transversely secured to the periphery between the parallel wheels;

a plurality of opposed spokes radiating from the hubs, rotatably mounted on each of the second shaft and extending beyond the rims of the subwheel; the opposing spokes of each subwheel being connected at the ends of the spokes;

a plurality of passenger cabs, each rotatably supported along its longitudinal axis, by a pair of third shafts, front and rear, said third shafts being rigidly connected to the ends of two adjacent spokes;

a spread bar transversly connected to the ends of two other adjacent spokes, alternately with the passenger cab;

means for rotating the passenger cabs;

a hydraulic system having first stationary pipes connected to a first pump for transmitting hydraulic fluid to and from a first motor for driving the main wheel; and second stationary pipes connected to a second pump for transmitting hydraulic fluid through commutators, to rotating pipes and second motors for driving the subwheels.

2. An improved amusement ride of claim 1 wherein the commutator are sealingly secured to the first shaft, forming annular spaced therewith, said spaces being in fluid communication with the second stationary pipes and the rotating pipes.

3. An improved amusement ride of claim 2 wherein one commutator is for transmitting hydraulic fluid from the second stationary pipe to the rotating pipe and the other commutator is for returning hydraulic fluid back to the second pump.

4. An amusement ride of claim 1 wherein the means for rotating the passenger cabs includes for each cab, a first gear fixed to a free end of the front third shaft, a second gear fixed at an opposite end of a steering wheel, said second gear being engaged with the first gear for rotation.

5. An amusement ride of claim 4 wherein the passenger cab has a three-sided cover, pivotally mounted in front of the cab for access to the cab.

6. An amusement ride of claim 5 wherein the spokes are detachably connected and towers having telescopic members whereby the ride can be transported in collapsed form by a trailer.

* * * * *